United States Patent [19]

Moffa et al.

[11] 4,089,139

[45] May 16, 1978

[54] SEGMENTED CYLINDRICAL REINFORCED PLASTIC MANHOLE STRUCTURE

[75] Inventors: Joseph Moffa, Middletown; Jerald H. Boynton, Franklin, both of Ohio

[73] Assignee: Armco Steel Corporation, Middletown, Ohio

[21] Appl. No.: 717,506

[22] Filed: Aug. 24, 1976

[51] Int. Cl.[2] ..... E02D 29/14

[52] U.S. Cl. ..... 52/20; 52/169.5; 52/245; 52/309.1; 52/589; 52/630

[58] Field of Search ..... 52/19–21, 52/245, 309, 169, 79, 630, 602, 247, 589, 590, 592; 404/25, 26; 220/4 R; 137/363, 364

[56] References Cited

U.S. PATENT DOCUMENTS

| | | | |
|---|---|---|---|
| 575,553 | 1/1897 | Nelles | 52/20 |
| 684,708 | 10/1901 | McFall | 52/20 |
| 871,655 | 11/1907 | Winslow | 52/20 X |
| 1,391,336 | 9/1921 | Meiners | 52/20 X |
| 1,793,038 | 2/1931 | Zimmermann | 404/26 |
| 2,324,039 | 7/1943 | Stone | 52/602 X |
| 2,698,193 | 12/1954 | Kennison | 52/245 X |
| 3,212,519 | 10/1965 | Paschen | 52/192 X |
| 3,263,378 | 8/1966 | Dorris | 52/20 |
| 3,474,584 | 10/1969 | Lynch | 52/309 |
| 3,543,457 | 12/1970 | Budlong | 52/20 X |
| 3,672,103 | 6/1972 | Kost | 52/20 |
| 3,850,457 | 11/1974 | Bigotte et al. | 52/21 X |
| 3,974,599 | 8/1976 | Grosh | 52/20 |

FOREIGN PATENT DOCUMENTS

| | | | |
|---|---|---|---|
| 2,110,743 | 6/1972 | France | 52/20 |

*Primary Examiner*—Ernest R. Purser
*Assistant Examiner*—Carl D. Friedman
*Attorney, Agent, or Firm*—Melville, Strasser, Foster & Hoffman

[57] ABSTRACT

A segmented cylindrical reinforced plastic manhole structure comprising a cylindrical body surmounted by a transition element. The transition element is adapted to support a conventional manhole cover and frame assembly and has an opening closable by the manhole cover. The manhole structure body comprises a plurality of curved, nestable segments of cast or molded reinforced plastic material. Each segment is provided with vertical side edges configured to provide an interlocking joint between it and an adjacent segment and the segments may be so sized as to require two, three or more segments to complete the circumference of the manhole structure body. Each segment is provided with horizontal top and bottom edges configured to provide an interlocking joint between it and an adjacent segment thereabove or therebelow so that the segments may be arranged in tiers to provide a manhole structure body of desired height. The transition element may also be cast or molded of reinforced plastic material and may be segmented or in the form of an integral one-piece structure. A cast reinforced concrete slab-like transition element may also be used. A base member may be provided for the manhole structure body, which base member may also be cast or molded of reinforced plastic material. The segments, transition element and the base member, if used, are joined together by an appropriate adhesive sealant to form fluid-tight joints therebetween.

28 Claims, 35 Drawing Figures

SEGMENTED CYLINDRICAL REINFORCED PLASTIC MANHOLE STRUCTURE

BACKGROUND OF THE INVENTION

1. Field of the Invention

The invention relates to a cylindrical reinforced plastic manhole structure and more particularly to such a structure, the body portion at least of which is made up of a plurality of nestable, curved segments.

2. Description of the Prior Art

While not necessarily so limited, the structure of the present invention finds particular utility as a manhole structure for a sanitary sewer system, a storm sewer system, for underground utilities or for industrial uses and the like.

Heretofor, prior art workers have devised numerous types of manhole, vault or catch basin structures. Tile has frequently been used as shown in U.S. Pat. No. 575,553. Corrugated metal has also been commonly used for such underground structures. Examples of this are shown in U.S. Pats. Nos. 1,265,767 and 3,390,225. U.S. Pat. No. 1,712,510 teaches a manhole casing made of inner and outer sheet metal liners with a binder material located therebetween. Manhole-like structures have often been constructed of brick, concrete block or precast concrete elements as is shown in U.S. Pat. Nos. 871,977 and 3,363,876.

More recently, prior art workers have become interested in preformed manhole structures made of reinforced plastic. U.S. Pat. No. 3,938,285, for example, teaches a preformed manhole comprising a dome section integrally joined to one end of a tubular body formed on an endlessly advancing mandrel. While such structures perform well, they are bulky, difficult to handle and expensive to ship from the place of manufacture to the use site. Furthermore, such preformed structures lack versatility with respect to their ability to be properly sized in height and the like to meet the needs of a particular site.

The present invention is directed to a reinforced plastic manhole structure, the cylindrical body of which is made up of a plurality of cast or molded curved segments which may be stacked and nested for purposes of shipment. The manhole structure of the present invention may be preassembled at a nearby plant, or it may be assembled at the site, in or out of the excavation prepared to receive it. The segments are light in weight and easily handled. Nevertheless, they are so constructed as to provide excellent ring stiffness and ring compression strength so that the completed manhole structure is capable of withstanding drag-down, live-load and ring compression. All of the segments may be identical to provide building block adjustability and the segments may be readily cut in the field to adjust the height of the structure. Alternatively, the segments may be made in various heights to achieve the desired final height of the completed manhole structure, all of the segments in a given tier thereof being of the same height. The segments may be easily cut to make appropriate openings for the receipt of conduit or pipe line adaptors. The final structure is leak proof and corrosion resistant. A cast or molded reinforced plastic base may be provided for the structure, or the structure may be used with a concrete base or the like. The upper end of the body of the manhole structure is provided with a transition element adapted to support a conventional manhole cover and frame assembly. The transition element may be dome-like and cast or molded of reinforced plastic material. The transition element may be an integral one-piece structure or segmented, as described hereinafter. The transition element may also take the form of a cast, reinforced, concrete slab-like element.

SUMMARY OF THE INVENTION

The segmented cylindrical reinforced plastic manhole structure of the present invention comprises a cylindrical body provided with a transition element at its upper end. The cylindrical body is made up of a plurality of curved segments cast or molded of reinforced plastic material and arranged in tiers. All of the segments used may be identical or the segments of one tier may vary in height from the segments of an adjacent tier to achieve a desired final height of manhole structure. The curved segments may be so sized that two, three or more are required to complete the circumference of the manhole structure body. To obtain the best trade-off between nestability of the segments during shipment and the minimum number of segments required for a given manhole structure, it is preferred that the segments be so sized as to require three of them to complete the circumference of the structure.

Each segment is provided with vertical side edges so configured as to result in an interlocking joint between that segment and adjacent segments. Each segment is further provided with horizontal top and bottom edges, again so configured as to provide an interlocking joint between that segment and adjacent segments thereabove or therebelow. As a consequence, the segments may be stacked or arranged in tiers to provide a manhole structure body of a desired height.

Each segment is provided with a smooth exterior surface to minimize drag-down forces thereon by the fill material surrounding the completed manhole structure. The interior surface of each segment has a plurality of horizontal ribs to provide ring stiffness and ring compression strength.

As used herein and in the claims, the term "transition element" refers to that element at the top of the manhole structure body which makes the transition from the large diameter of the manhole to the smaller diameter access opening defined and closed by a conventional manhole cover and frame assembly. The transition element may be cast or molded of reinforced plastic material and may be a one-piece, integral dome-like structure. Alternatively, the transition element may be formed of two or more identical segments. Yet another transition element in the form of a slab-like, reinforced, concrete structure will be described hereinafter.

The manhole structure may be provided with a poured concrete base or a base cast or molded of reinforced plastic material, as will be described hereinafter. Finally, the segments making up the body portion of the manhole structure can be readily cut both for height adjustment of the structure and to provide openings for the receipt of conduit or pipe line adaptors, again as will be described hereinafter.

BRIEF DESCRIPTION OF THE DRAWINGS

FIG. 10 is a fragmentary cross sectional view illustrating a typical horizontal joint between a pair of adjacent segments.

FIG. 14 is a fragmentary cross sectional view illustrating one form of joint between the transition element and an adjacent segment.

FIG. 15 is a fragmentary cross sectional view similar to FIG. 14 and illustrating another type of joint between the transition element and an adjacent segment.

DESCRIPTION OF THE PREFERRED EMBODIMENTS

Figure 1:
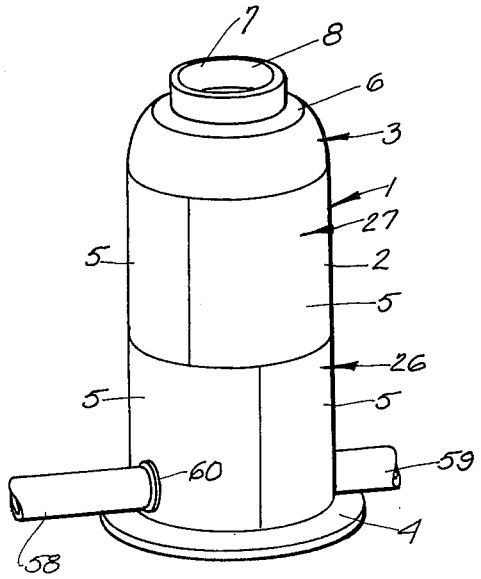
FIG. 1 is a fragmentary perspective view of the segmented cylindrical manhole structure of the present invention with conduits or pipe line means connected thereto.
Figure 2:
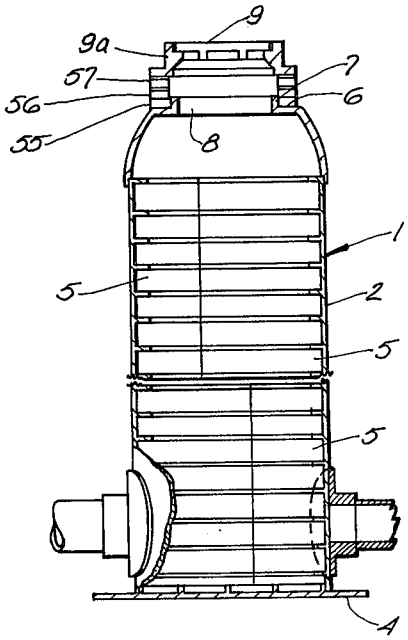
FIG. 2 is a fragmentary, cross sectional, elevational view of the manhole structure of the present invention.
Figure 1D:
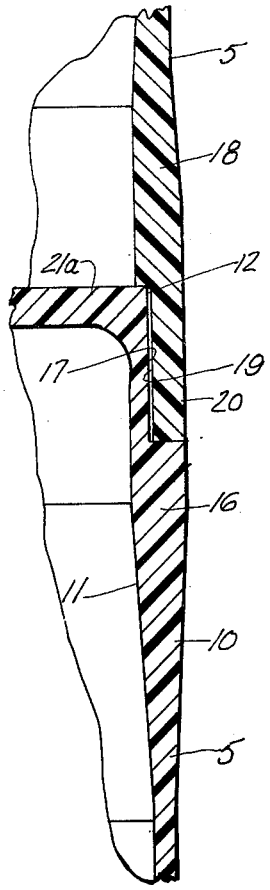
Figure 1A:
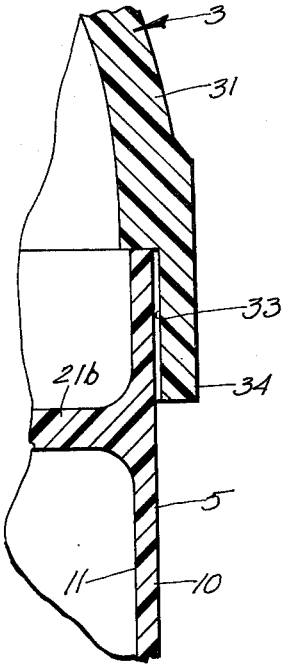
Figure 1B:
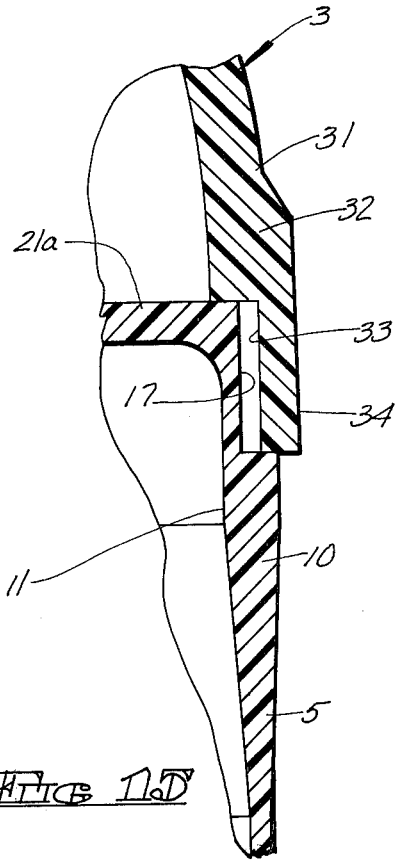

To best comprehend the overall nature of the manhole structure of the present invention, reference is first made to FIGS. 1 and 2 wherein like parts have been given like index numerals. FIG. 1 is a perspective view of a manhole structure of the present invention and FIG. 2 is a cross sectional view including a frame and cover assembly and supporting brick therefor. The manhole structure is generally indicated at 1 and comprises a cylindrical body portion 2 surmounted by a transition element 3. Where desired, the manhole structure 1 may be provided with a base 4.

Figures 5, 6, 7, 8, 9:
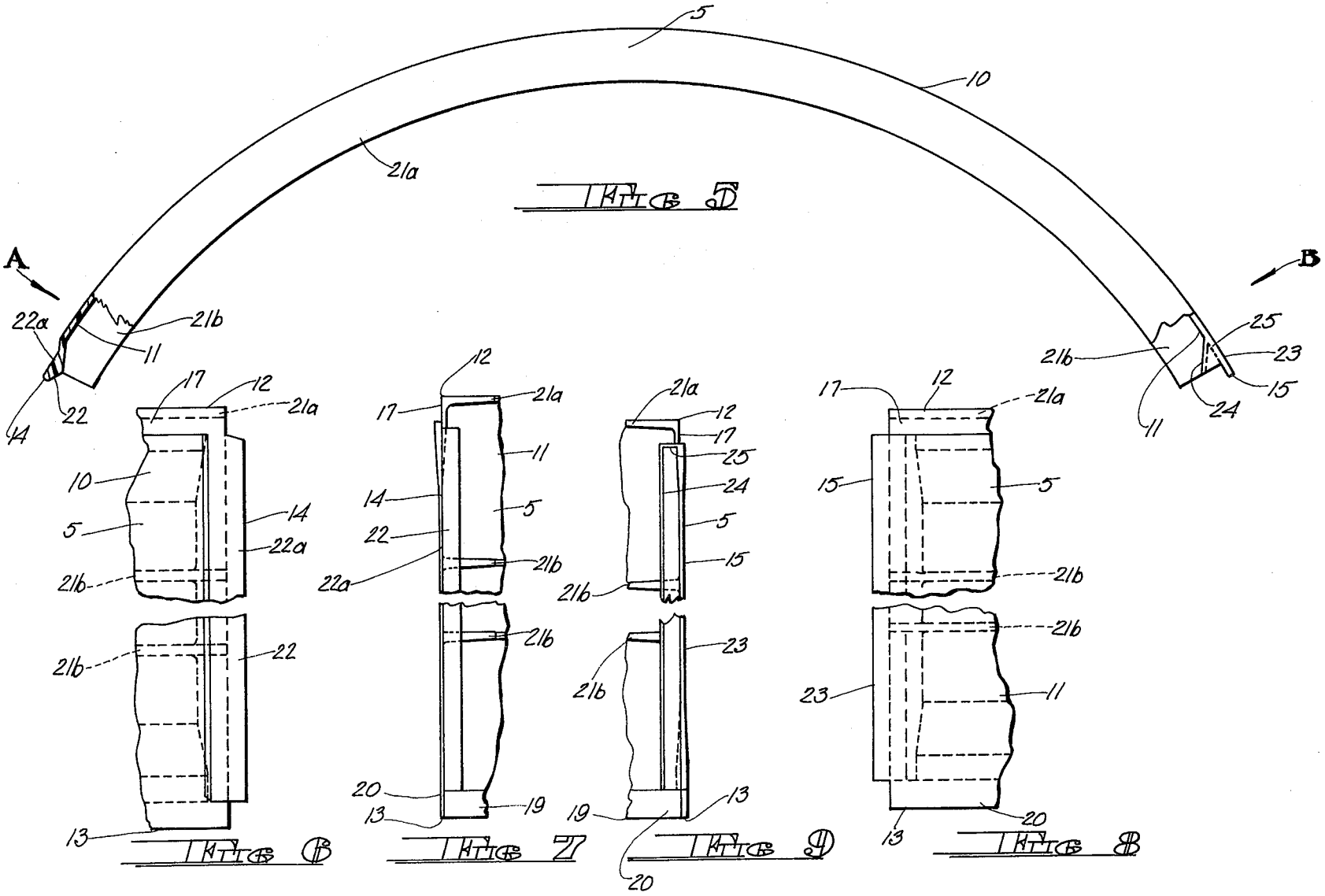
FIG. 5 is a top plan view of the segment of FIG. 3, partly in cross section.
FIG. 6 is a fragmentary elevational view of the tongued end of the segment of FIG. 5, as viewed in the direction of arrow A of that Figure.
FIG. 7 is a fragmentary end elevational view of the structure of FIG. 6 as viewed from the right thereof.
FIG. 8 is a fragmentary elevational view of the grooved or socket end of the segment of FIG. 5 as viewed in the direction of arrow B of FIG. 5.
FIG. 9 is a fragmentary end elevational view of the structure of FIG. 8 as viewed from the left thereof.

The body portion 2 of the manhole structure is built up of a plurality of segments 5. As indicated above, the fabricating of body portion 2 from segments 5 is advantageous in that the manhole may be shipped in unassembled condition with the segments nested. At least two segments are required in each segment tier to complete the 360° circumference of body portion 2. The segments may be so sized that three or more are required to complete the circumference. In the preferred embodiment, three segments are required for this purpose, each segment constituting 120° of the circumference of its respective tier. This will be evident from FIGS. 3 and 5. The segment of the present invention will be described in detail hereinafter.

As will be evident from FIGS. 1 and 2, the transition element 3 curves gently upwardly and inwardly and terminates in an annular shoulder 6 and an upstanding annular flange 7 defining an access opening 8. The annular shoulder 7 is intended to support a conventional manhole cover 9 and frame 9*a* therefor. Transition element 3 will be described in detail hereinafter.

Figure 3:
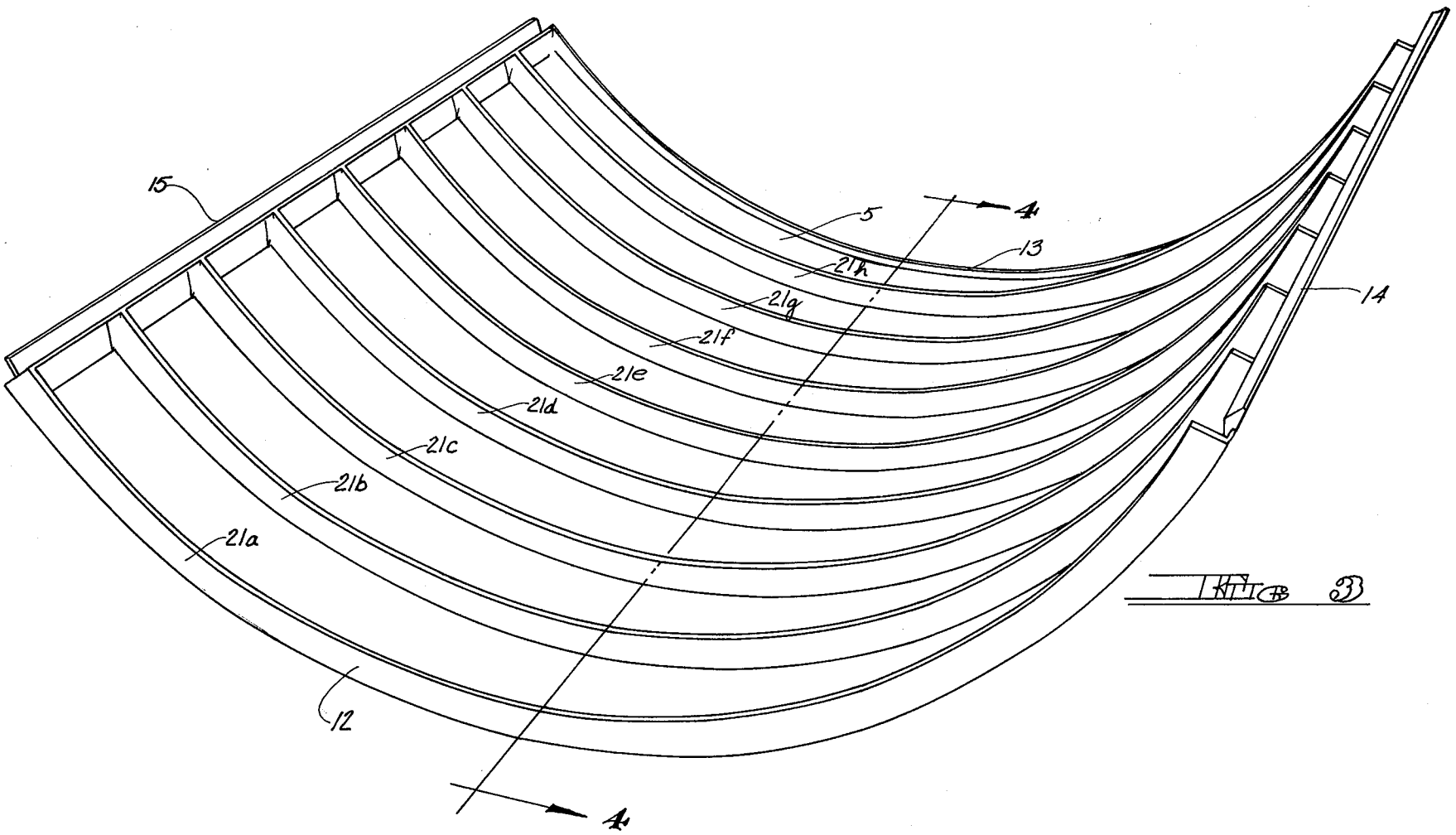
FIG. 3 is a perspective view of a segment of the body portion of the manhole structure.
Figure 4:
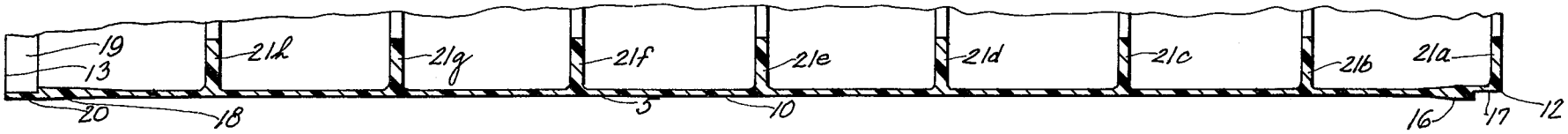
FIG. 4 is a cross sectional view taken along section line 4—4 of FIG. 3.

Turning to FIGS. 3 and 4 wherein a segment 5 is illustrated, the segment is a curved panel-like structure having an exterior surface 10, an interior surface 11, a top edge 12, a bottom edge 13 and side edges 14 and 15.

The exterior surface 10 of the segment 5 is substantially smooth and uninterrupted. This will assure that the exterior surface of the assembled manhole structure body will be substantially smooth and free of projections to reduce friction that can cause draw-down forces by the back fill material surrounding the manhole structure once installed. This is important because it is possible for back fill material to display substantial settlement (drag down) during and after the installation operation.

At its upper end 12 the segment thickens slightly as at 16 (see FIG. 4) and its exterior surface 10 is provided with a notch 17. At its lower end, the segment 5 thickens slightly as at 18 (see FIG. 4) to accommodate a notch 19 on its interior surface 11. The notch 19 defines a downwardly depending flange 20. When the segments are arranged in tiers (one above the other) to form the body portion 2 of the manhole structure 1, the flange 20 at the lower edge of one segment will engage the notch 17 at the upper edge of the segment therebelow to form a joint. Such a joint is illustrated in FIG. 10 wherein like parts are given like index numerals. It will be understood that an appropriate adhesive sealant, compatable with the material of which the segments are made, will be located between notch 17 and flange 20 to permanently join together the adjacent segments and to form a fluid-tight joint.

Returning to FIGS. 3 and 4, it will be noted that the interior surface 11 of the segment is provided with a plurality of horizontal ribs, parallel to each other and equally spaced from each other. The ribs are shown in FIGS. 3 and 4 at 21*a* through 21*h*. It will be noted that the first rib 21*a* is located at the uppermost edge 12 of the segment 5. The lowermost edge 13 of the segment is not provided with a rib. This is true because the uppermost rib of the next segment therebelow will serve as a reinforcing rib for the bottom edge of the segment thereabove. This is clearly shown in FIG. 10. Each of the ribs 21*a* through 21*h*, as they extend away from the interior surface of 11 of the segment 5, are slightly tapered for ease in releasing the segment from its mold in the casting or molding operation by which the segment is made and to reduce the tendency for debris to collect on the upper rib surface.

The provision of ribs 21*a* through 21*h* on each segment will assure that the completed manhole structure will demonstrate excellent ring stiffness and ring compression strength. Ring stiffness may be defined as resistance to bending and is shown by the equation $K/EI$, where $K$ is a function of loading; $E$ is the modulus of elasticity; and $I$ is the moment of inertia. Compression strength may be defined as the resistance to buckling by a circular structure to a uniformly applied external force, i.e. that amount of force which must be exceeded to cause failure. Furthermore, this is true even though the ribs permit the thickness of the segment between its exterior surface 10 and interior surface 11 to be far thinner than would otherwise be required (in the absence of the ribs) to achieve good ring stiffness and ring compression strength characteristics. This, in turn, results in a marked savings in the material from which the segments are molded. In an exemplary embodiment, reinforced plastic segments were so sized as to require three to make up a complete tier having an outside diameter of 51 inches. The segments were 49 inches high and were provided with 8 ribs 1.375 inches wide, 0.250 inches thick and spaced 6 inches apart. Except for the thickened portions near the top and bottom edges of the segments, the segment walls were 0.125 inches thick. Assuming the same loading conditions and reinforced plastic material, a ribless segment of comparable ring stiffness would require a wall thickness of 0.7218 inches. Thus the ribbed segment would have only 1/3.95 as much reinforced plastic material as would the ribless segment and would be nearly 4 times as efficient in the use of the reinforced plastic material. As a consequence, the manhole structure of the present invention constitutes a high strength, light weight, inexpensive structure.

It will be understood that the segments 5 may be so sized as to make up a manhole of any desired diameter. Depending upon the diameter of the manhole to be constructed and the consequent size of the segments 5, the number, width, thickness and spacing of the ribs can be so arranged as to provide the desired ring stiffness and ring compression strength for the structure. The determination of these parameters is well within the skill of the worker in the art. While not intended to be so limited, the segments may be so sized as to provide manhole structures ranging in inside diameters from about 42 to about 72 inches with 48 inches being the most commonly used. The manway opening 8 may range in diameter from about 20 to about 28 inches. Segments may be produced in various heights, as for example 1, 2 and 4 feet.

The vertical joints between adjacent segments in a given tier may take any appropriate form. For example, they may be of the groove and flange type described with respect to the horizontal joint between adjacent segments of adjacent tiers and shown in FIG. 10. In the embodiment illustrated, however, the vertical joints are of a tongue-and-groove nature. To this end, reference is now made to FIGS. 3, 5, 6 and 7 wherein like parts are given like index numerals. The side edge 14 of the segment has a tongue 22 formed integrally thereon. The tongue 22 extends from a point just short of the top edge 12 of segment 5 to a point just short of the bottom edge 13 of the segment. The outside surface 22*a* of tongue 22 is substantially coextensive with notch 17 at the upper end of the segment.

The end 15 is provided with a first flange 23 constituting a continuation of the outside surface 10 of the segment 5. A second flange 24 diverges inwardly with respect to flange 23. The flanges 23 and 24 extend to a position just short of the upper edge 12 of the segment 5 and to a position just short of the lower edge 13 thereof. At their upper ends, the flanges 23 and 24 are joined by a web 25. It will be evident from FIGS. 3 and 5 through 8 that when two adjacent segments of a given tier are joined side by side to form a vertical joint, the tongue 22 of one of the segments will be received within the socket or groove formed between the flanges 23 and 24 of the adjacent segment. Flange 23 of the one segment will overlie the surface 22*a* of the tongue 22 of the adjacent segment. Since the surface 22*a* of the tongue 22 is substantially coextensive with the notch 17 the outer surface of flange 23 will be substantially coextensive with the outer surface of the adjacent segment so that a smooth joint is formed. The upper end of the tongue 22 on the one segment will abut the web 25 joining flanges 23 and 24 on the adjacent segment. This will assure proper vertical alignment of the adjacent segments. Again, this tongue-and-groove joint will be provided with an appropriate adhesive sealant so as to form a permanent, fluid-tight vertical joint.

In the embodiment illustrated, three identical segments will be joined to make a tier. The manhole structure of FIG. 1 is illustrated as being two tiers high, the tiers being generally indicated at 26 and 27. The manhole structure of FIG. 2 is broken to indicate that the structure may be made up of any number of tiers to achieve the desired, overall height.

Figure 11:
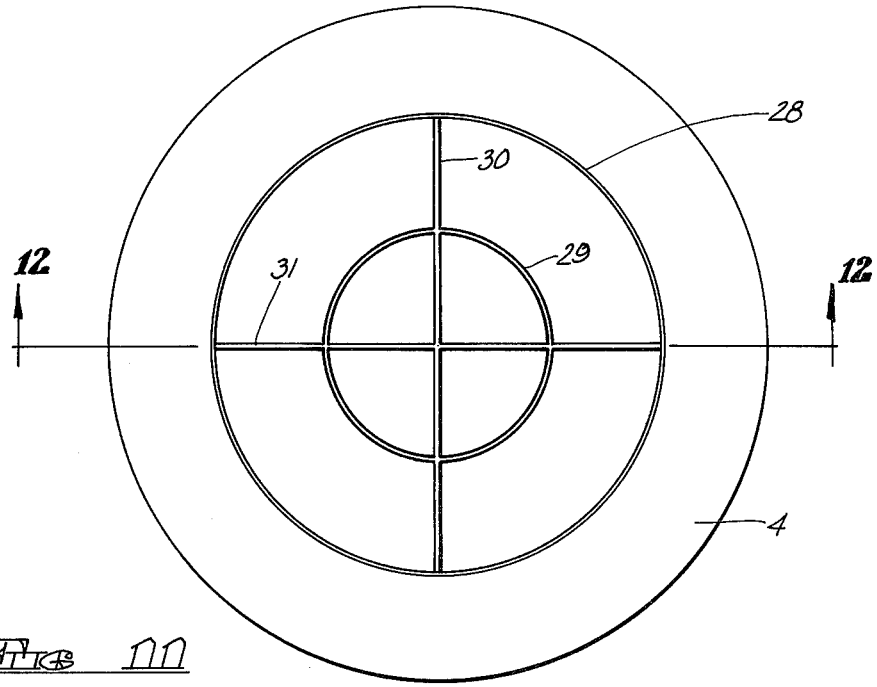
FIG. 11 is a plan view of a base for the manhole structure of the present invention.
Figure 12:
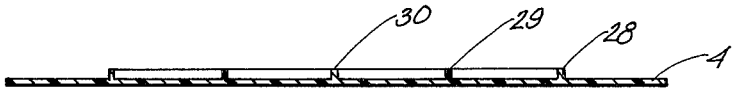
FIG. 12 is a cross sectional view taken along section line 12—12 of FIG. 11.

The manhole structure of the present invention may be provided with a foundation or base of any appropriate type. For example, a concrete base may be used, either precast or cast-in-place. Alternatively, a base may be used which is molded or cast of a reinforced plastic material. Such a base is illustrated at 4 in FIGS. 1 and 2. The base 4 is more clearly shown in FIGS. 11 and 12 and comprises a flat disc-like element of greater diameter than the diameter of the body portion 5 of the manhole structure. The base may be formed with upstanding, reinforcing ribs constituting an integral, one-piece part of the base. A first such rib is shown at 28 in FIGS. 11 and 12 and constitutes a continuous, circular rib. The outside diameter of rib 28 is substantially equal to the inside diameter of the notch 19 defining the flange 20 on the lower edge of the segments. As a consequence, the rib 28 will lie adjacent the flanges 20 of the lowermost tier of segment 5. An appropriate adhesive sealant will be used between the rib 28 on base member 4 and the flanges 20 of the lowermost tier of segments so as to permanently join the lowermost tier of segments to the base member with a fluid-tight joint. A second continuous, circular rib 29 may be formed on base member 4, concentric with and of lesser diameter than the rib 28. To complete the structure, a pair of diametric ribs 30 and 31 may be formed on the base member, the last mentioned ribs being oriented 90° with respect to each other. As ribs 28 through 30 extend upwardly from the base 4, they taper slightly to assist in release of the base member from its mold during the casting or molding operation thereof.

As indicated above with respect to FIGS. 1 and 2, the manhole structure of the present invention is provided with a transition element 3 providing an access opening 8 for the manhole structure. The transition element 3 serves to reduce the diameter of the structure from the large diameter of body portion 5 to the smaller diameter of the access opening or manway 8 which may be closed by a conventional manhole cover and frame assembly 9 and 9*a* (see FIG. 2).

Figure 13:
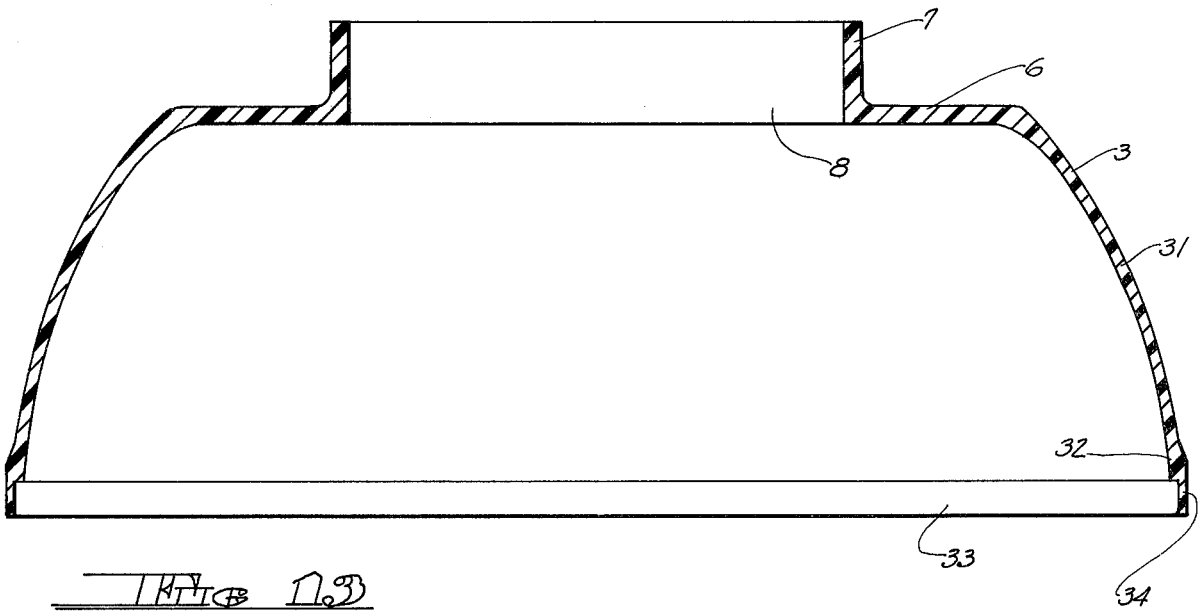
FIG. 13 is a cross sectional elevational view of a transition element of the present invention.

An exemplary transistion element is shown in the cross sectional elevational view of FIG. 13. Again, like parts have been given like index numerals. In the embodiment illustrated in FIG. 13, the transition element 3 constitutes a unitary, integral, one-piece structure molded or cast of reinforced plastic material. As is evident from FIG. 13, the transition element 3 has a body portion 31 in the shape of a truncated dome terminating at its upper end in the annular shoulder 6. The upstanding flange 7 defines the access opening 8, as described above. At its lowermost edge the body portion 31 of the transition element 3 thickens slightly, as at 32, to accomodate an annular interior notch 33 defining a downwardly depending annular flange 34.

The achievement of a particular desired height for the manhole structure may be accomplished in several ways. For example, all of the segments of the manhole body structure may be identical and so sized that when arranged in predetermined numbers of tiers various standard sizes of manhole structures will result. While all of the segments of a given tier should be of the same height, segments of various heights may be produced and arranged in tiers to achieve a final desired height for the structure. When this is done, the segments may be substantially identical except for height. Finally, to achieve a particular height for the manhole structure (whether all of the segments of all of the tiers are identical in height or not), the uppermost tier of the segments 5 of body portion 2 may be cut horizontally at any point between ribs 21*a* through 21*h*.

The annular notch 33 defining the flange 34 on the transition element 3 has an internal diameter slightly larger than the external diameter of the body portion 2 of the manhole structure so that the uppermost edge of the body portion may be received in the annular notch 33. This is illustrated in FIG. 14, wherein like parts have been given like index numerals. It will be understood that the joint illustrated in FIG. 14 will be provided with an appropriate adhesive sealant (not shown) to permanently affix the transition element 3 to the uppermost tier of segments and to form a fluid-tight joint.

In instances where the desired height of the manhole structure does not require horizontal cutting of the uppermost tier of segments, the joinder of the transition element 3 to the uppermost tier of segments will be made in substantially the same manner. In this instance, however, there will be a slightly larger gap between the annular notch 33 of the transition element and the adjacent segments of the upper tier by virtue of the peripheral exterior notch 17 in the segments (see FIG. 15). This gap can be filled with the above mentioned adhesive sealant material (not shown) to form a solid, fluid-tight joint.

It will be understood that for purposes of shipping, transition elements of the type shown at 3 in FIG. 13 can readily be nested. For an even greater economy of space, it is within the scope of the present invention to form the transition element of two or more identical segments. For purposes of an exemplary showing, FIGS. 16 through 24 illustrate a transition element made up of two identical segments.

Figure 16:
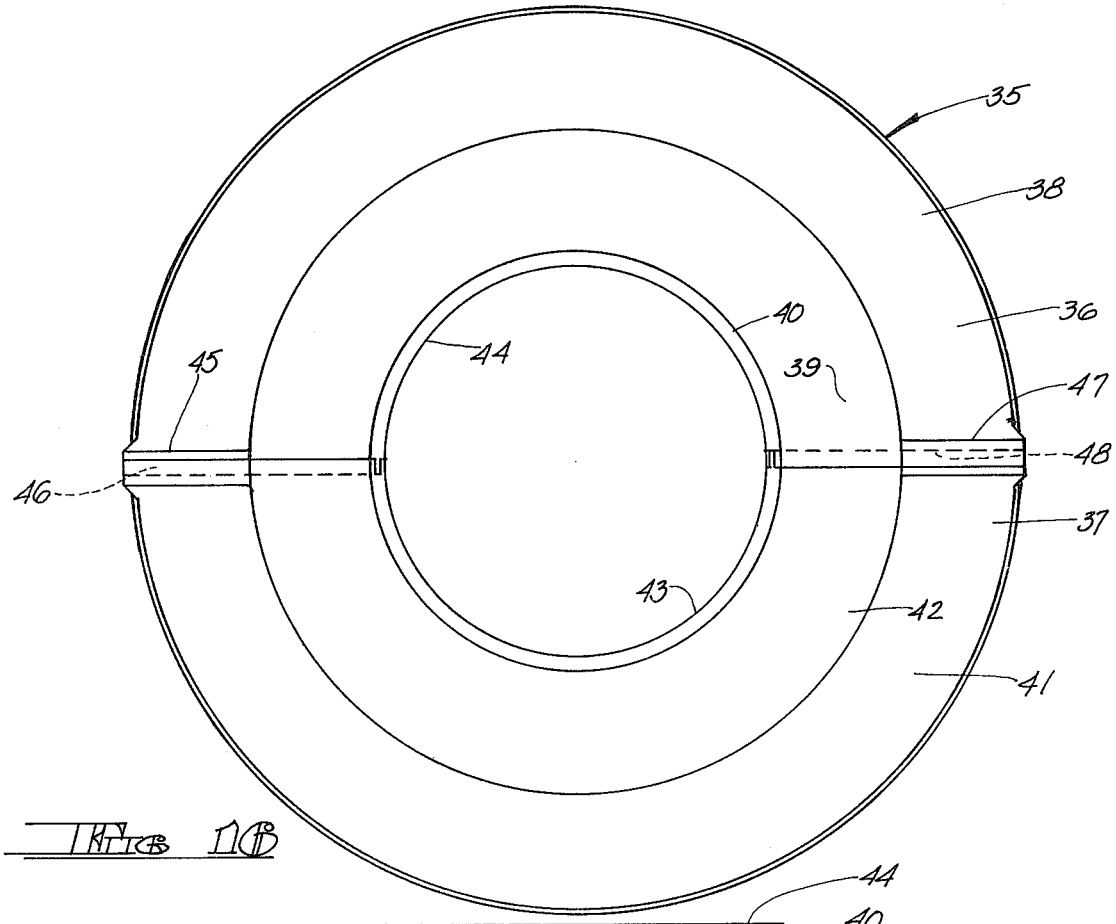
FIG. 16 is a top plan view of a transition element made up of two identical segments.

In FIG. 16 the transition element is generally indicated at 35. It is made up of two identical segments 36 and 37. The overall shape and purpose of transition element 35 is the same as that of transition element 3 of FIG. 13.

Figure 17:
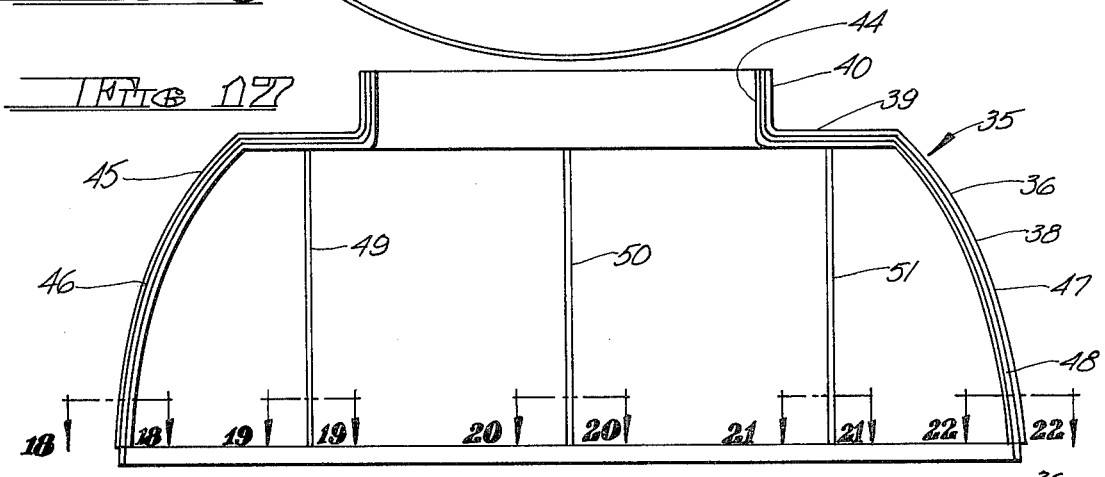
FIG. 17 is an elevational view of one of the segments of FIG. 16.

FIG. 17 illustrates segment 36 (segment 37 being identical). Segment 36 comprises a body portion 38 constituting a truncated half dome terminating at its upper end in a semi-circular shoulder 39 and an upwardly extending semi-circular flange 40. As is shown in FIG. 16, the segment 37 has a body portion 41 identical to body portion 38 of segment 36 together with a semi-circular shoulder 42 and a semi-circular upstanding flange 43 identical to the shoulder 39 and flange 40 of segment 36. The shoulders 39 and 42, when the parts are assembled, will form a continuous annular shoulder. In a similar fashion, the upstanding flanges 40 and 43 will form a continuous annular flange defining an access opening 44.

Figure 18:
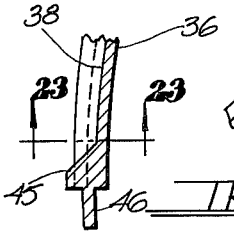
FIG. 18 is a fragmentary cross sectional view taken along section line 18—18 of FIG. 17.
Figure 19:
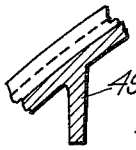
FIG. 19 is a fragmentary cross sectional view taken along section line 19—19 of FIG. 17.
Figure 20:
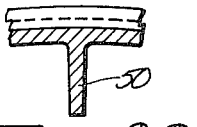
FIG. 20 is a fragmentary cross sectional view taken along section line 20—20 of FIG. 17.
Figure 21:
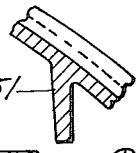
FIG. 21 is a fragmentary cross sectional view taken along section line 21—21 of FIG. 17.
Figure 22:
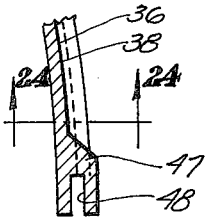
FIG. 22 is a fragmentary cross sectional view taken along section line 22—22 of FIG. 17.
Figure 23:
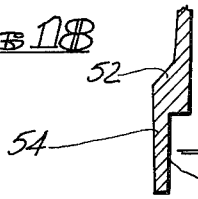
FIG. 23 is a fragmentary cross sectional view taken along section line 23—23 of FIG. 18.
Figure 24:
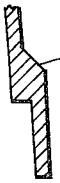
FIG. 24 is a fragmentary cross sectional view taken along section line 24—24 of FIG. 22.

Returning to FIG. 17 the left edge of segment 36 (as viewed in that Figure) is slightly thickened as at 45 (see also FIGS. 16 through 18). This edge of segment 36 is provided with a forwardly projecting tongue 46 which extends continuously along the body portion 38, the shoulder 39 and the flange 40. This tongue 46 is clearly shown in the cross sectional view of FIG. 18.

The right edge of segment 36 (as viewed in FIG. 17) is slightly thickened as at 47. This enables the provision of a slot 48 extending continuously along the body portion 38, the shoulder 39 and the flange 40. Slot 48 is clearly shown in the cross sectional view of FIG. 22. To lend both ring stiffness and ring compression strength to transition element 35 as well as to limit vertical deflection under load, the segment 36 is provided with three internal reinforcing ribs 49, 50 and 51. These ribs are shown in the cross sectional views of FIGS. 19 through 21. As the ribs extend inwardly from body portion 38 they taper slightly to assist in release of the segment from its mold during the molding or casting operation by which it is made Body portion 38, near its lower edge, is slightly thickened as at 52 (see FIGS. 23 and 24). This accommodates an internal annular notch 53 defining a downwardly depending flange 54 equivalent to the notch 33 and flange 34 of the transition element 3 of FIG. 13.

It being remembered that segments 36 and 37 are identical, segment 37 will have a slot equivalent to slot 48 adapted to receive the tongue 46 of segment 36.

Similarly, segment 37 will have a tongue equivalent to tongue 46 of segment 36 which is received in the slot 48 of segment 36. Again an adhesive sealant will be used at the joints between segments 36 and 37 to permanently join them and to form a fluid-tight seal at the joints.

The manhole cover 9 and its frame 9a may be supported directly by the transition element 3. As is clearly shown in FIG. 2, the manhole cover 9 and its frame 9a can lie on one or more courses of bricks or the like supported by the shoulder 6 of transition element 3. An increment of height adjustment can be made by providing the required number of brick courses. For purposes of an exemplary showing three brick courses are shown in FIG. 2 at 55 through 57. Concrete rings or the like may be substituted for the brick courses 55 through 57. It will be understood that the manhole cover 9 and its frame 9a may be similarly mounted on the segmented transition element 35 of FIG. 16.

As indicated with respect to FIG. 1, one or more pipes or conduits may lead into the manhole structure. For purposes of an exemplary showing, two coaxial, diametrically opposed pipes 58 and 59 are shown in FIG. 1. The number and positioning of such pipes or conduits do not constitute a limitation on the present invention. It will be further understood that the nature of the pipe or conduit used does not constitute a limitation on the present invention. For example, the pipe may be of the type taught in U.S. Pat. No. 3,379,221. For ease of installation and to permit some flexibility to accommodate for settlement of the pipe, it is preferred to join the pipe or conduit to the manhole structure by means of an adaptor affixed to the manhole at the position where the pipe or conduit is to be connected thereto. An exemplary adaptor is indicated at 60 in FIG. 1. The adaptor 60 is more clearly illustrated in FIGS. 25, 26 and 27.

The adaptor 60 comprises a first cylindrical portion 61 and a second cylindrical portion 62 of greater external diameter. Portions 61 and 62 are of the same internal diameter which is slightly greater than the external diameter of the pipe to be received therein. The portion 62 is of greater exterior diameter to accommodate an annular interior notch 63 for receipt of a resilient gasket 64 (see FIG. 27). The portion 62 is provided with an exterior flange 65. As is shown in the top plan view of FIG. 26, flange 65 is curved so that its inner surface 65a will conform to the exterior surface of the body portion 2 of the manhole structure 1.

To attach the adaptor 60 to the manhole structure body 2, it is only necessary to cut a substantially circular opening at the appropriate position in one of the segments thereof, the opening having a diameter larger than the external diameter of the adaptor portion 62 and smaller than the peripheral diameter of the adaptor flange 65. The adaptor portions 61 and 62 are then inserted through the opening and the adaptor is sealed and adhered to the manhole structure body by means of an appropriate adhesive sealant located between the surface 65a of adaptor flange 65 and the adjacent exterior surface of the manhole body portion. The pipe or conduit to be installed (for example pipe 58 of FIG. 1) is inserted into the adaptor from the exterior surface thereof and to any depth desired. The resilient gasket 64 will make a fluid-tight seal with the exterior surface of the pipe.

Figure 28:
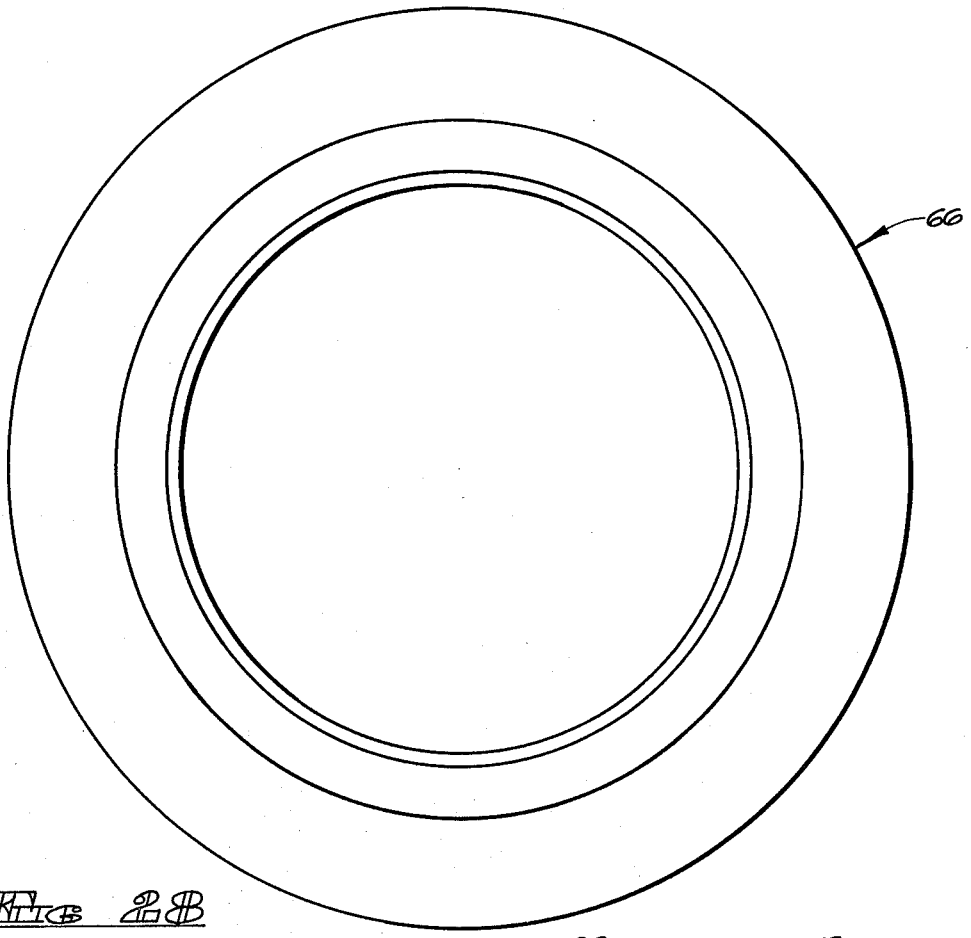
FIG. 28 is an elevational view of another adaptor embodiment for joining a pipe of conduit to the manhole structure of the present invention.
Figure 29:
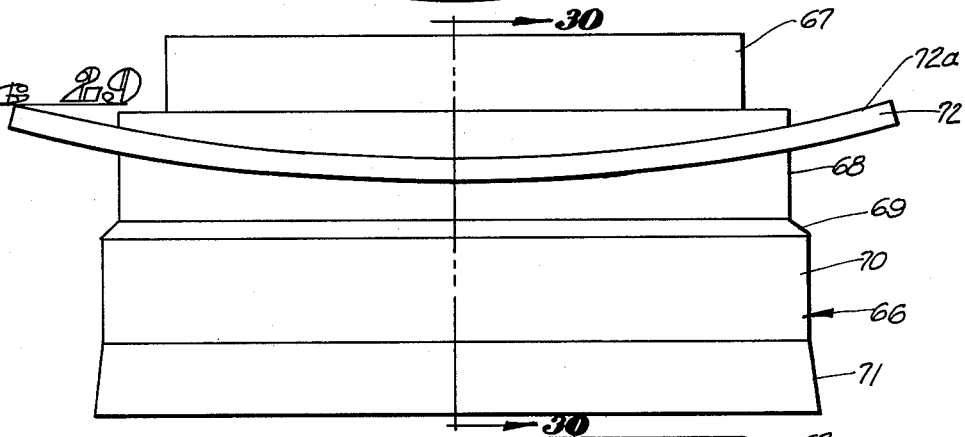
FIG. 29 is a top view of the structure of FIG. 28.
Figure 30:
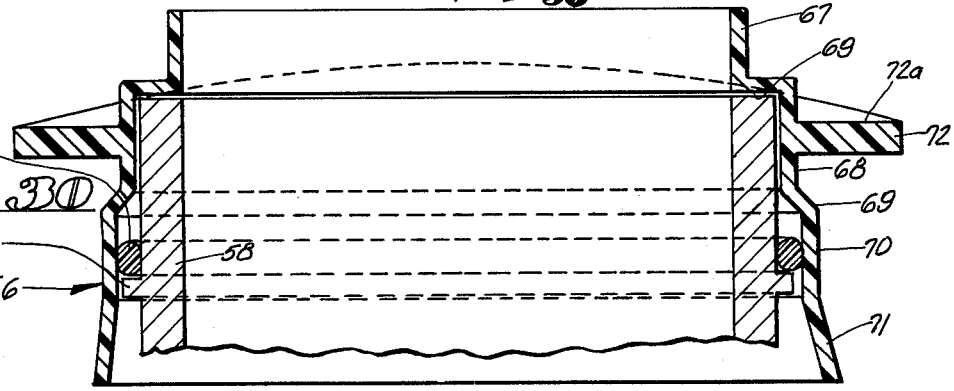
FIG. 30 is a cross sectional view taken along section line 30—30 of FIG. 29 and fragmentarily illustrating a pipe or conduit mounted in the adaptor.

FIGS. 28 through 30 illustrate another adaptor suitable for use with the manhole structure of the present invention. The adaptor is generally indicated at 66 and comprises a substantially cylindrical structure having a first portion 67 with an internal diameter less than the external diameter of the pipe or conduit to be inserted therein. Preferably, the internal diameter of portion 67 is substantially the same as the internal diameter of the pipe or conduit used. A second portion 68 of the adaptor has an internal diameter slightly greater than the diameter of the pipe or conduit used. An annular shoulder 69 is formed between portions 68 and 67 (see FIG. 30). The portion 68 is followed by an outwardly flaring portion 69, a cylindrical portion 70 of yet greater internal diameter and another outwardly flared portion 71. Finally, the portion 68 is provided with an external flange 72 which, as can most clearly be seen in FIGS. 29 and 30, is curved so as to provide a surface 72a substantially conforming to the exterior surface of the body portion 2 of the manhole structure 1.

Figure 25:
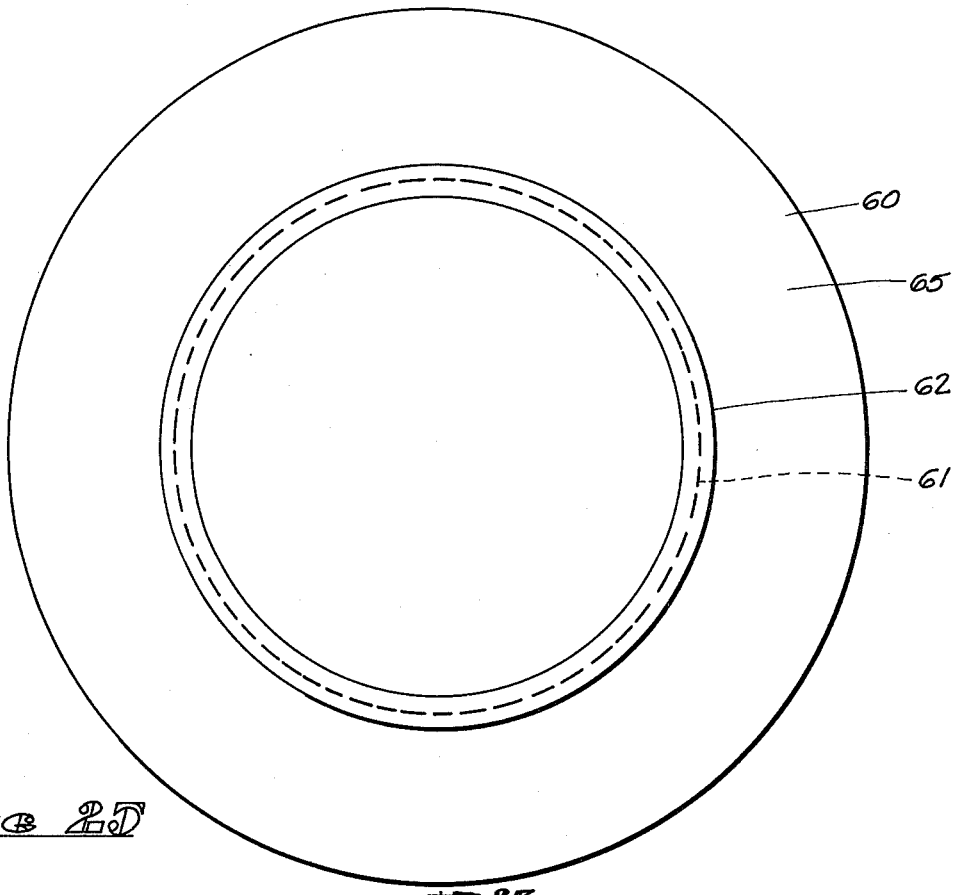
FIG. 25 is a front elevational view of an adaptor for joining a pipe or conduit to the manhole structure of the present invention.
Figure 26:
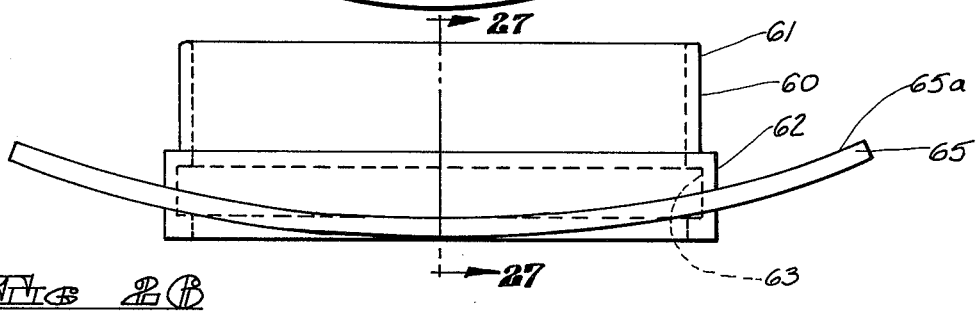
FIG. 26 is a top plan view of the adaptor of FIG. 25.
Figure 27:
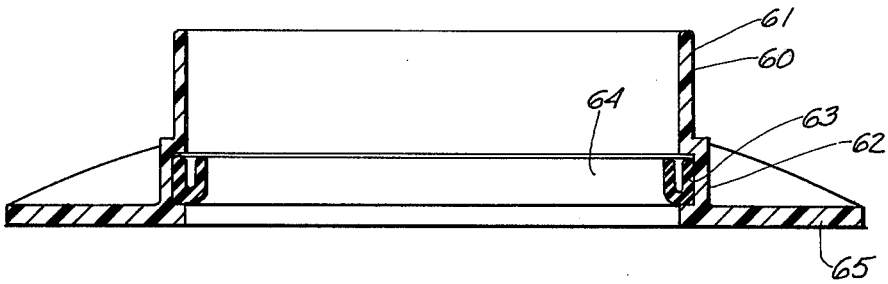
FIG. 27 is a cross sectional view taken along section line 27—27 of FIG. 26.

The mounting of the adaptor 66 to the manhole body 2 is accomplished in substantially the same way described with respect to the adaptor 60 of FIGS. 25 through 27. To this end, an opening is cut in the appropriate segment of the manhole body, the opening having a diameter larger than the diameter of adaptor portion 68 and smaller than the peripheral diameter of flange 72. Portions 67 and 68 are inserted through the opening and an adhesive sealant is located between the surface 72a of flange 72 and the adjacent surface portion of the manhole structure body. This will assure that the adaptor 66 is securely fastened to the manhole structure with a fluid-tight seal.

The pipe or conduit 58 may be provided with an exterior annular flange 73 and an O-ring gasket 74. When the pipe or conduit 58 is inserted into the adaptor 66, the flared portions 71 and 69 of the adaptor will assist in guiding it. The pipe or conduit 58 is inserted until its forwardmost end abuts the annular shoulder 69 of the adaptor. When fully seated, the gasket 74 will form a seal between the exterior surface of pipe or conduit 58, the annular flange 73 and the cylindrical portion 70 of the adaptor.

In the use of either adaptor described above the interior diameter of the adaptor may be so matched with the exterior diameter of the pipe or conduit as to permit slight shifting of the pipe or conduit due to settlement or the like. This shifting will be accommodated by the gaskets 63 or 74 so that the fluid-tight seal between the pipe or conduit and the adaptor will be maintained. Openings in the body of the manhole structure for attachment of the adaptors thereto may be readily made in the field through the use of an appropriate tool such as a saber saw or the like. The openings can, of course be preformed in a selected one or ones of the segments 5 prior to field assembly, if desired.

The adaptors 60 and 66 may be made of any appropriate material. Excellent results may be achieved when they are fabricated of fiber glass reinforced plastic (FRP) or acrylonitrile-butadiene-styrene plastic (ABS).

The elements of the manhole structure of the present invention may all be cast or molded of an appropriate plastic material, selected as to be compatable with the conditions to be encountered by the manhole structure. Excellent results have been achieved, for example, in the use of a fiber glass reinforced thermosetting polyester material. Where the parts are to be joined, the joinder is accomplished with an appropriate adhesive sealant system compatable with the material from which the parts were cast or molded.

Yet another type of transition element is illustrated in FIGS. 31 through 35. Like parts have been given like index numerals in all of these figures. The transition element of this embodiment is indicated at 75 and comprises a reinforced, precast, concrete, slab-like element having a circular peripheral configuration. The transition element 75 may be interiorly reinforced with steel bars (not shown), in a manner well known in the art.

Figure 35:
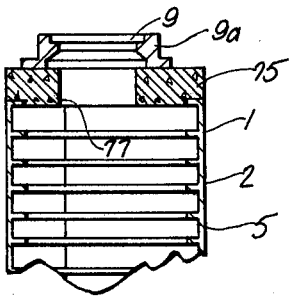
FIG. 35 is a fragmentary, cross sectional elevational view illustrating a manhole structure of the present invention provided with a transition element of the type illustrated in FIG. 31.

The outside diameter of the transition element 75 is at least equal to the outside diameter of the manhole body portion 2 (see FIG. 35).

An annular notch 76 is cast in the transition element and is so sized as to permit the transition element to be received within the uppermost rib of the uppermost tier of segments or within the wall of the uppermost tier of segments (should be uppermost tier of segments have been horizontally cut for height adjustment). A cement type mortar will be located at the position of notch 76 to form a fluid tight joint between transition element 75 and the body portion 2 of the manhole.

Figure 31:
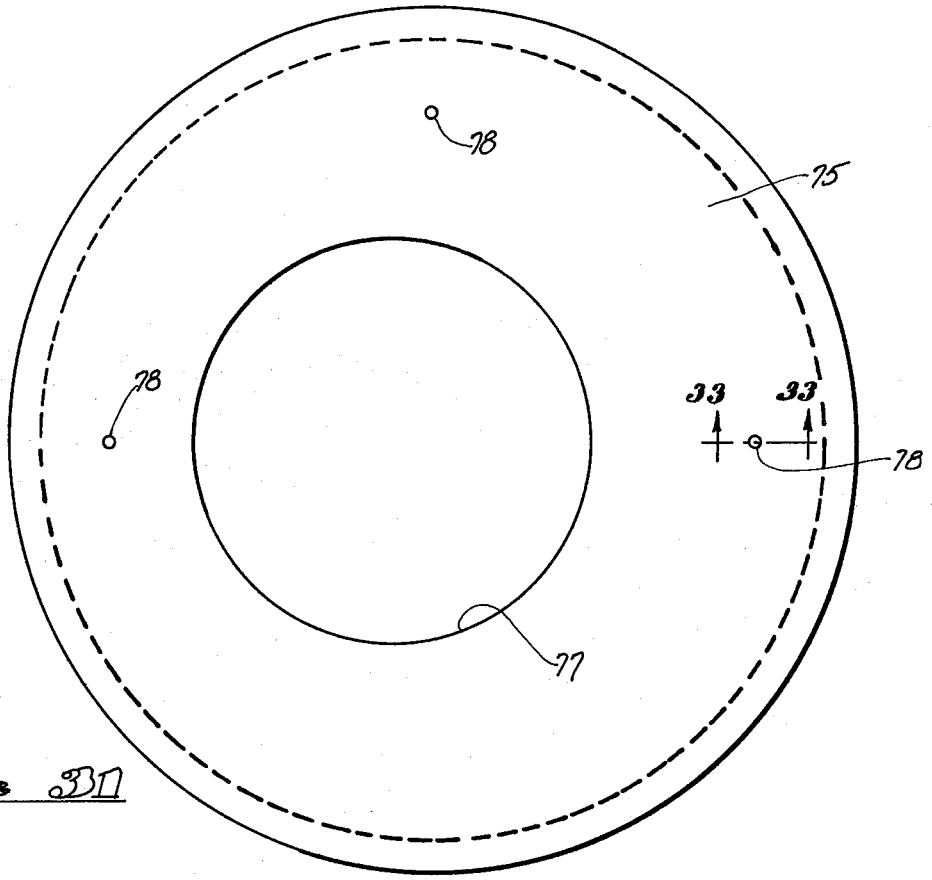
FIG. 31 is a plan view of another transition element embodiment.
Figure 32:
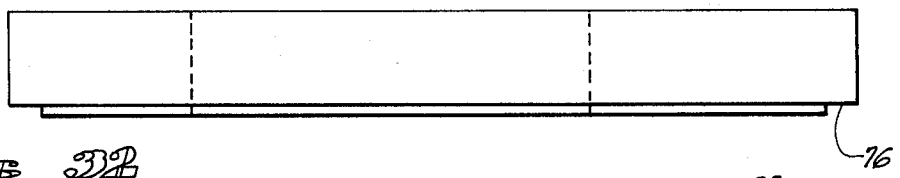
FIG. 32 is an elevational view of the transition element of FIG. 31.

Transition element 75 will have formed therein an access hole or manway 77. While not necessarily so limited, the manway 77 may be located off center as shown in FIGS. 31, 32 and 35 to permit ready access to a ladder (not shown) mounted on the interior surface of the manhole structure.

Transition element 75 is intended to support a conventional manhole cover and frame assembly 9—9*a* of the type described with respect to FIG. 2. The frame 9*a* may be located directly on transition element 75 (as shown in FIG. 35) or a final increment of height adjustment may be made by providing brick courses, precast rings of concrete, or the like, as described with respect to FIG. 2.

Figure 33:
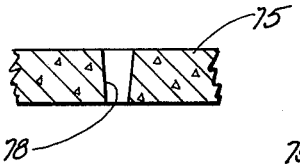
FIG. 33 is a cross sectional view taken along section line 33—33 of FIG. 31 and illustrating a lifting hole in the transition element.
Figure 34:
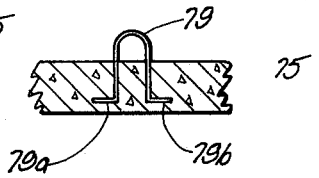
FIG. 34 is a cross sectional view similar to FIG. 33 and illustrating the provision of a lifting loop.

To assist in the handling of transition element 75, it may be provided with a plurality of lifting holes 78. One lifting hole 78 is illustrated in FIG. 33. The lifting holes 78 permit the transition element 75 to be engaged by appropriate equipment for lifting and locating the transition element in place on the manhole body portion 2. As is clear from FIG. 33, the lifting holes 78 are preferably tapered downwardly and inwardly so that they may be readily plugged and sealed (in known manner) once the transition element 75 has been installed.

Alternatively, the transition element 75 may be provided with a series of lifting loops. One such lifting loop is shown at 79 in FIG. 34 the lifting loop simply comprises an inverted U-shaped member made of rod stock. The free ends of the loop legs are bent outwardly as at 79*a* and 79*b*. The lifting loops 79 are embedded in the transition element 75 during the casting operation. Once the transition element 75 has been installed, the exposed portions of the lifting loop may be removed, if desired, by the use of a torch or other appropriate means.

Modifications may be made in the invention without departing from the spirit of it.

The embodiments of the invention in which an exclusive property or privilege is claimed are defined as follows:

1. A segmented manhole structure comprising a hollow body surmounted by a transition element, said body being cylindrical about a vertical axis with upper and lower ends, said body comprising at least one tier of curved nestable reinforced plastic segments, at least two segments being required for each tier, each of said segments comprising a thin-walled cylindrical segment curved about a vertical axis, the exterior surface of said segment wall being substantially smooth and uninterrupted, the interior surface of said segment wall being provided with a plurality of evenly spaced inwardly extending horizontal ribs, the uppermost one of said ribs being located along said top edge of said segment, the lowermost one of said ribs being spaced upwardly from said bottom edge of said segment such that when said manhole body comprises more than one tier the ribs of segments located one above the other will be evenly spaced throughout the height of said body, said ribs of each of said segments extending substantially from one vertical edge of said segment to the other whereby, when said segments are joined together to form a tier, said interior ribs of said segments form substantially continuous annular ribs, each said segments having vertical side edges configured to provide an interlocking vertical joint between it and an adjacent one of said segments in said at least one tier, each of said segments having horizontal top and bottom edges configured to provide an interlocking horizontal joint between it and adjacent segments of adjacent tiers thereabove and therebelow when said body comprises more than one tier, said segments of said body being joined together by an adhesive sealant at said vertical and horizontal interlocking joints rendering said joints fluid tight, said transition element being supported on said upper end of said body, means for forming a fluid-tight seal between said transition element and said upper end of said body, said transition element having an access opening therein and being configured to support a conventional manhole cover and frame assembly to close said access opening.

2. The structure claimed in claim 1 wherein all of said segments are identical.

3. The structure claimed in claim 1 wherein said body comprises more than one tier of said segments, at least the segments of each tier being identical.

4. The structure claimed in claim 3 wherein each of said tiers comprises three of said segments.

5. The structure claimed in claim 1 wherein said body comprises more than one tier of said segments, all of the segments of each tier being identical, the segments of at least one of said tiers differing in height from the segments of the remaining tiers.

6. The structure claimed in claim 5 wherein each of said tiers comprises three of said segments.

7. The structure claimed in claim 1 wherein said segments are molded of reinforced plastic.

8. The structure claimed in claim 1 wherein said segments are molded of fiber glass reinforced thermosetting polyester material.

9. The structure claimed in claim 1 wherein said at least one tier comprises three identical segments.

10. The structure claimed in claim 1 including an opening formed in said cylindrical manhole body, a hollow adaptor extending partway into said opening, said adaptor having an annular flange, said annular flange being transversely curved to conform to and to abut the exterior surface of said body about said opening therein, said flange being attached to said exterior surface of said body by an adhesive sealant, said adaptor being configured to receive the end of a conduit and to make a fluid-tight seal therewith.

11. The structure claimed in claim 10 wherein said hollow adaptor comprises a first cylindrical portion terminating in a second cylindrical portion of greater outside diameter, said second cylindrical portion terminating in said annular flange, said first cylindrical portion being located within said manhole body, said second cylindrical portion extending through said opening in said manhole body, said annular flange having a diameter greater than said opening, said first and second cylindrical portions having the same inside diameter so sized as to receive said conduit, said second cylindrical portion having an annular notch formed in the interior surface thereof, a resilient annular gasket located within said annular notch to make a fluid tight seal between said adaptor and said conduit.

12. The structure claimed in claim 10 wherein said hollow adaptor comprises first, second and third cylindrical portions, said second cylindrical portion having an inside diameter and an outside diameter greater than those of said first cylindrical portion and less than those of said third cylindrical portion with a first annular shoulder formed between said first and second cylindrical portions and a second annular shoulder formed between said second and third cylindrical portions, said first cylindrical portion being located within said manhole body, said second cylindrical portion passing through said opening in said manhole body and having said annular flange thereon, said third cylindrical portion being located outside said manhole body, the inside diameter of said first cylindrical portion being substantially equal to the inside diameter of said conduit, said second cylindrical portion just nicely receiving said conduit with said first shoulder being a stop therefor, the inside diameter of said third cylindrical portion being so sized as to make sealing contact with a resilient gasket mounted on said conduit.

13. The structure claimed in claim 10 wherein said adaptor is an integral one-piece structure molded of fiber glass reinforced plastic.

14. The structure claimed in claim 10 wherein said adaptor is an integral one-piece structure molded of acrylonitrile-butadiene-styrene plastic.

15. The structure claimed in claim 1 including a base for said manhole structure, said base comprising a flat, disc-like element molded of reinforced plastic material and having a diameter larger than the outside diameter of said cylindrical manhole body, said base having an integral upstanding circular rib having an outside diameter substantially equal to the inside diameter of said manhole body such that said manhole body may be located on said base with said upstanding circular rib adjacent the inside surface of said body at said lower end thereof, said manhole body being joined to said base by an adhesive sealant located between said circular base rib and said adjacent inside surface of said manhole body.

16. The structure claimed in claim 1 wherein said transition element comprises a structure of reinforced plastic material in the shape of a truncated dome terminating at its upper end in an annular shoulder surrounding a circular upstanding flange defining said access opening, said shoulder being configured to support said frame of said conventional manhole cover and frame assembly.

17. The structure claimed in claim 16 wherein said transition element comprises a unitary integral one-piece structure.

18. The structure claimed in claim 16 wherein said transition element has a downwardly extending flange along the bottom edge thereof, said flange extending about the exterior of said upper end of said manhole body, an adhesive sealant located between and joining said transition element flange and said upper end of said manhole body making a fluid-tight seal therebetween.

19. The structure claimed in claim 16 wherein said transition element comprises at least two identical nestable segments, each segment having a forwardly projecting tongue formed along one vertical edge thereof and extending substantially the length of said vertical edge, each segment having a groove formed in the other vertical edge thereof and extending substantially the length of said other vertical edge, said groove of one segment receiving said tongue of the adjacent segment such that said segments may be joined together by means of an adhesive sealant to form said transition element.

20. The structure claimed in claim 1 wherein said transition element comprises a precast, reinforced, concrete slab-like element having a circular peripheral edge and said access opening extending downwardly therethrough, said transition element having an outside diameter at least equal to the outside diameter of said manhole body, said transition element having an annular peripheral notch formed therein at the bottom thereof adapted to receive said upper end of said manhole body and means for forming a fluid-tight seal therebetween.

21. The structure claimed in claim 17 wherein said access opening is offset from the center of said transition element.

22. The structure claimed in claim 1 wherein one side edge of each segment has an integral tongue extending therefrom and along the majority of the length thereof, the other edge of said segment having a groove extending along the majority of the length thereof, the tongue of each segment of a tier being receivable within the groove of the adjacent segment of the same tier to form said interlocking vertical joint therebetween, each of said segments having a notch formed in said exterior surface thereof along said upper edge thereof, each of said segments having a notch formed in said interior surface thereof along said lower edge thereof forming a downwardly depending flange such that said downwardly depending flange of each segment will engage said exterior notch along the upper edge of a segment located therebelow to form said interlocking horizontal joint therebetween.

23. The structure claimed in claim 19 wherein each of said tiers comprises three of said segments.

24. A molded reinforced plastic segment for use in a manhole structure of the type comprising a body cylindrical about a vertical axis, made up of at least one tier of said segments and surmounted by a transition element having an access opening and supporting a conventional manhole cover and frame assembly, said segment comprising a thin-walled cylindrical segment curved about a vertical axis with vertical side edges and horizontal top and bottom edges, the exterior surface of said segment wall is substantially smooth and uninterrupted, the interior surface of said segment wall is provided with a plurality of evenly spaced, inwardly extending horizontal ribs, the uppermost one of said ribs being located along said top edge of said segment, the lowermost one of said ribs being spaced upwardly from said bottom edge of said segment such that when said body comprises more than one tier, the ribs of segments located one above the other will be evenly spaced throughout the height of said body, said ribs of said segment extending substantially from one vertical edge of said segment to the other whereby, when said segment is joined to another to form a tier, said interior ribs of said segments will form substantially continuous annular ribs, each of said vertical side edges of said segment being configured to provide an interlocking vertical joint between it and the vertical edge of an adjacent one of said segments in a tier thereof, each of said horizontal top and bottom edges of said segment being configured to provide an interlocking horizontal joint between it and the horizontal edge of an adjacent segment of adjacent tiers thereabove and therebelow when said manhole body comprises more than one tier, said segment being nestable with another identical segment.

25. The structure claimed in claim 24 wherein said segment is so sized as to require three thereof to make up a full 360° tier.

26. The structure claimed in claim 24 wherein one of said vertical side edges of said segment has an integral tongue extending therefrom and along the majority of the length thereof, the other of said vertical side edges of said segment having a groove extending along the majority of the length thereof, the tongue of said segment being receivable within the groove of another such segment to form an interlocking vertical joint therebetween, said segment having a notch formed in said exterior surface thereof along said upper edge thereof, said segment having a notch formed in said interior surface thereof along said lower edge thereof forming a downwardly depending flange such that said downwardly depending flange of said segment will engage said exterior notch along the upper edge of another such segment located therebelow to form an interlocking horizontal joint therebetween.

27. The structure claimed in claim 26 wherein said segment is so sized as to require three thereof to make up a full 360° tier.

28. A segmented manhole structure comprising a hollow body surmounted by a transition element, said body being cylindrical about a vertical axis with upper and lower ends, said body comprising at least one tier of curved nestable reinforced plastic segments, at least two segments being required for each tier, each of said segments having vertical side edges configured to provide an interlocking vertical joint between it and an adjacent one of said segments in said at least one tier each of said segments having horizontal top and bottom edges configured to provide an interlocking horizontal joint between it and adjacent segments of adjacent tiers thereabove and therebelow when said body comprises more than one tier, said segments of said body being joined together by an adhesive sealant at said vertical and horizontal interlocking joints rendering said joints fluid tight, each of said segments having a substantially smooth and uninterrupted exterior surface and inwardly extending horizontal ribs on its interior surface so that said manhole structure body has a substantially smooth and uninterrupted exterior surface and an interior surface with inwardly extending horizontal, substantially continuous, annular ribs, said transition element being supported on said upper end of said body, means for forming a fluid-tight seal between said transition element and said upper end of said body, said transition element having an access opening therein.

* * * * *